US005700081A

United States Patent [19]

Mengle et al.

[11] Patent Number: 5,700,081

[45] Date of Patent: Dec. 23, 1997

[54] DECORATIVE LIGHT ASSEMBLY

[75] Inventors: Jay S. Mengle; Baker A. Mitchell, Jr.; Marsha A. Mengle, all of Houston, Tex.

[73] Assignee: Holiday Innovations, Inc., Houston, Tex.

[21] Appl. No.: 638,356

[22] Filed: Apr. 26, 1996

[51] Int. Cl.[6] ..... F21P 1/02

[52] U.S. Cl. ..... 362/123; 362/226; 362/227; 362/806

[58] Field of Search ..... 362/123, 226, 362/227, 806

[56] References Cited

U.S. PATENT DOCUMENTS

| | | | |
|---|---|---|---|
| 1,974,472 | 9/1934 | Seghers | 362/123 |
| 2,110,353 | 3/1938 | Barkes | 362/806 |
| 2,201,045 | 5/1940 | Lundstrom | 240/10 |
| 2,205,496 | 6/1940 | Schneider | 248/229 |
| 2,402,766 | 6/1946 | Moore | 240/10 |
| 2,558,029 | 6/1951 | Wood | 240/10 |
| 2,875,421 | 2/1959 | Jordan | 339/22 |
| 3,096,943 | 7/1963 | Forrer | 240/10 |
| 3,118,617 | 1/1964 | Hellrich | 240/10 |
| 3,120,351 | 2/1964 | Kirsten | 240/10 |
| 3,214,579 | 10/1965 | Pacini | 240/10 |
| 3,617,732 | 11/1971 | Fisher | 240/10 |
| 3,641,335 | 2/1972 | Wall | 240/10 P |
| 3,723,723 | 3/1973 | Lerner | 362/806 |
| 3,770,951 | 11/1973 | Corelli et al. | 240/10 T |
| 4,012,631 | 3/1977 | Creager | 240/10 T |
| 4,228,486 | 10/1980 | Matsuya | 362/806 |
| 4,425,605 | 1/1984 | Cheng | 362/806 |
| 4,516,193 | 5/1985 | Murphy | 362/123 |
| 4,573,102 | 2/1986 | Norwood | 362/123 |
| 4,573,108 | 2/1986 | Castiglia et al. | 362/123 |
| 4,620,270 | 10/1986 | Laakso | 362/123 |
| 4,667,276 | 5/1987 | Cheng | 362/252 |
| 4,713,586 | 12/1987 | Chiang | 315/200 |
| 4,720,773 | 1/1988 | Ahroni | 362/806 |
| 4,777,573 | 10/1988 | Liao | 362/806 |
| 4,779,177 | 10/1988 | Ahroni | 362/806 |
| 4,870,547 | 9/1989 | Crucefix | 362/123 |
| 4,899,266 | 2/1990 | Ahroni | 362/252 |
| 4,901,960 | 2/1990 | Gary | 248/205.3 |
| 5,057,976 | 10/1991 | DuMong | 362/123 |
| 5,121,310 | 6/1992 | Ahroni | 362/226 |
| 5,150,964 | 9/1992 | Tsui | 362/806 |
| 5,245,519 | 9/1993 | Openiano | 362/252 |
| 5,339,232 | 8/1994 | Lin | 362/226 |
| 5,639,157 | 6/1997 | Yeh | 362/806 |

OTHER PUBLICATIONS

Silvestri Sales Corporation, *The Magic of Silvestri. The Best for Less.*, (date unknown).

European (EPO) Search Report dated Apr. 2, 1997.

*Primary Examiner*—Stephen F. Husar

*Assistant Examiner*—Matthew Spark

*Attorney, Agent, or Firm*—Vaden, Eickenroht & Thompson, L.L.P.

[57] ABSTRACT

A decorative light assembly for illuminating a tree includes an electrical cable having primary input and output conductors, a plug at one end thereof, and being adapted for placement within the tree about the trunk thereof. At least one light string cluster stems from the electrical cable and includes a plurality of looped components adapted for extending along the branches or subbranches of the tree and electrically connected to one another, and a plurality of bulb sockets electrically connected at spaced intervals in series along the respective looped components. The looped components and bulb sockets together create a dense distribution of lights in the tree when the looped conductors are extended along the branches or subbranches of the tree.

9 Claims, 2 Drawing Sheets

DECORATIVE LIGHT ASSEMBLY

BACKGROUND OF THE INVENTION

1. Field of the Invention

The present invention relates to decorative lighting assemblies, and more particularly, to improved decorative lighting assemblies adapted to be installed in a tree such as a Christmas tree.

2. The Related Art

The art related to ornamental tree lighting assemblies is typified by elongated "strings" of 50, 100, or more low voltage bulbs electrically connected to one another. One or more of these light strings are placed in a tree by draping the string over or across the branches of the tree generally about the trunk of the tree. A problem common among such light strings is that it takes a considerable amount of time, and often requires two or more people, to place the light strings about the tree and later remove the light strings from the tree. Furthermore, the light strings are prone to becoming entangled when taken off the tree for storage, primarily due to the great length of the strings, and it takes a considerable amount of time to untangle them when the time comes, e.g., next Christmas, to install the lights in a tree again. Also, several strings are required to adequately cover the full area of tree, particularly with taller trees, and the strings often become entangled with one another during the installation process. Finally, because the typical placement of light strings in a tree, such as a Christmas tree, requires that the strings be draped across, rather than along, the branches of the tree, the electrical wiring of the strings is clearly visible and detracts from the ornamental effect of the lighting assembly.

One attempt to solve at least certain of these problems is disclosed in U.S. Pat. No. 4,012,631, wherein a long central primary conductor is run vertically up a Christmas tree, with a plurality of elongated secondary conductors electrically connected in parallel to the central conductor at spaced intervals. Each of the secondary conductors have two short tertiary conductors electrically connected thereto in parallel adjacent the distal ends of the secondary conductors. The distal ends of the secondary conductors and the tertiary conductors each are connected to a single light bulb socket. The secondary conductors are run along the branches of the tree, and are suspended underneath the branches with a plurality of clips.

While the hanging of the secondary conductors along the branches may hide the electrical wiring better than the previously known light assemblies, the resulting light assembly of the '631 patent provides light sources only about the periphery of the tree, and as such lacks "depth" or density in its illumination effect. Also, the central conductor is very long and must be wrapped about the tree trunk to hold it up and this necessarily requires "threading" at least a portion of the entire assembly though each and every branch of the tree at the interfaces of the branches with the trunk. The lengths of the primary and secondary conductors virtually ensure that the assembly will experience the same tangling problems as ordinary Christmas light strings, and these lengths are not easily adaptable to trees of varying sizes. Furthermore, the use of parallel connections at all electrical connections necessitates the use of larger, heavier wire sizes and junctions than if some series connections were utilized.

It is therefore an object of the present invention to provide an ornamental light assembly that produces a brilliant illumination effect exhibiting "depth" by placing a very dense cluster of light sources throughout the tree and along the branches thereof.

It is a further object to provide an ornamental light assembly that reduces the time of installation and removal of the light assembly from a tree, and reduces or eliminates the problem of tangling.

It is a further object to provide an ornamental light assembly that permits the wiring and junction sizes to be smaller and lighter in weight.

It is a still further object to provide an ornamental light assembly that is readily adaptable to real and artificial trees of virtually any size.

SUMMARY OF THE INVENTION

The objects described above, as well as other objects and advantages, are achieved by a decorative light assembly which includes an electrical cable having primary input and output conductors with a plug at one end thereof, and being adapted for placement within a tree about the trunk thereof. At least one light string cluster stems from the electrical cable and includes a plurality of looped components each prearranged for extending along a branche or subbranch of the tree and electrically connected to one another, and a plurality of bulb sockets electrically connected at spaced intervals in series along the respective looped components. The looped components and bulb sockets together create a dense distribution of lights in the tree when the looped components are extended along the branches or subbranches of the tree.

Preferably, the cable of the decorative light assembly further includes a receptacle at the end opposite the plug to facilitate the electrical connection of one such assembly to another. Also, the length of the cable does not substantially exceed six feet in length to ensure that the assembly will not easily entangle and that it can be quickly installed in a tree.

In one embodiment, the decorative light assembly includes a plurality of light string clusters similar to and including the one light string cluster that are electrically connected in series with one another to form one electrical pathway between the primary input and output conductors.

In another embodiment, a second plurality of light string clusters is electrically connected in series with one another to form a second electrical pathway between the primary input and output conductors of the cable in parallel with the one electrical pathway.

In a still further embodiment, the looped components and bulb sockets of the one light string cluster together form at least two electrical pathways in parallel with one another between the primary input and output conductors of said cable. In this embodiment, a plurality of light string clusters similar to and including the one light string cluster are electrically connected in parallel to the cable.

BRIEF DESCRIPTION OF THE DRAWINGS

In the drawings, wherein like reference characters are used throughout to describe like parts.

DETAILED DESCRIPTION OF THE PREFERRED EMBODIMENT

Figure 1A:
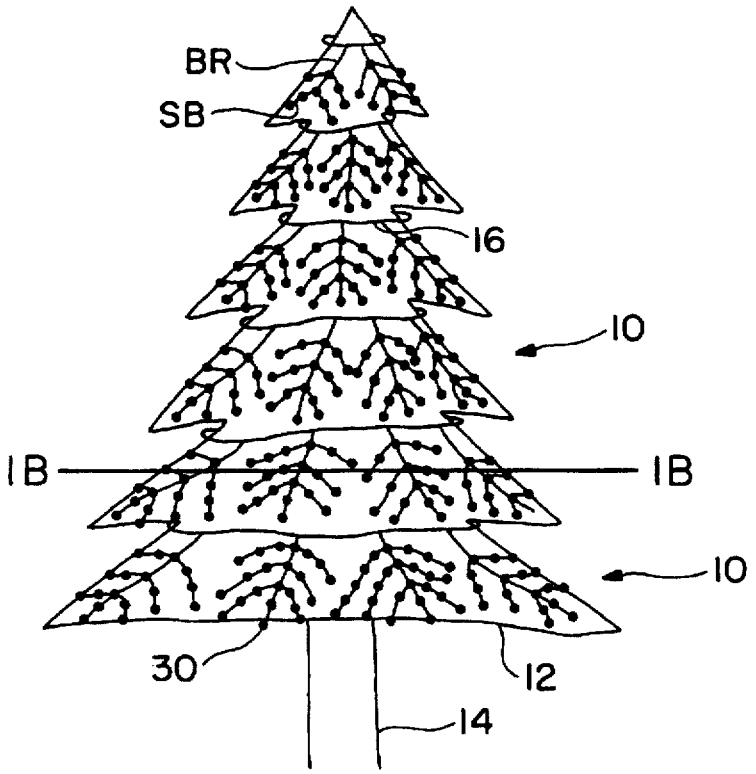
FIG. 1A is an elevational view of a Christmas tree decorated with several ornamental light assemblies in accordance with the present invention.
Figure 1B:
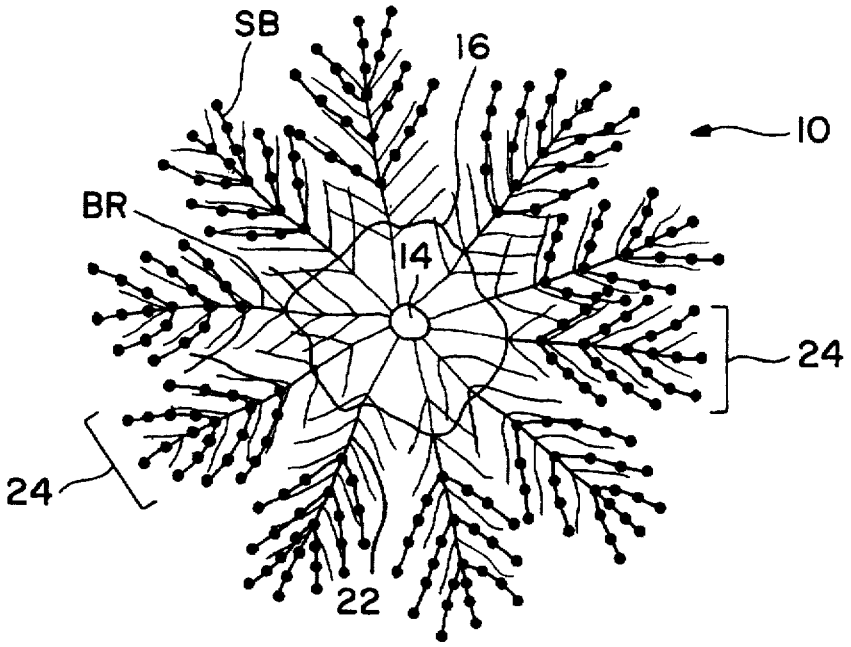
FIG. 1B is a plan sectional view taken along section line 1B—1B of FIG. 1A.

FIGS. 1A and 1B illustrate a typical Christmas tree 12 having a trunk 14, branches BR stemming from the trunk, and subbranches SB stemming from the branches. The tree contains several more or less divisible layers wherein branches and subbranches of similar elevations reside, with FIG. 1B illustrating a section taken through the second layer from the bottom that is shown in FIG. 1A.

Tree 12 is decorated with a plurality of decorative lighting assemblies, generically referenced as 10, one or more of which are positioned throughout each layer of the tree. FIG. 1B illustrates decorative light assembly 10 as including a plurality of light string clusters 24 (described further below), one for each branch BR stemming from trunk 14 of tree 12.

Figure 4:
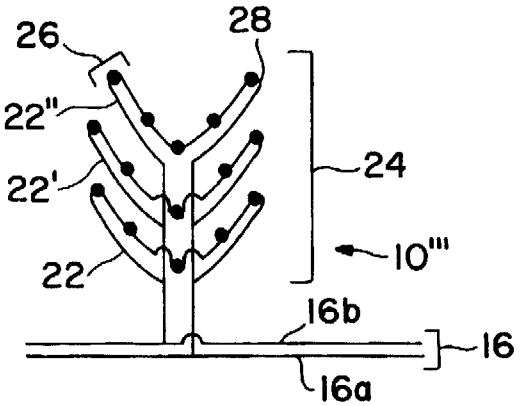
FIG. 4 is an electrical schematic of a low voltage embodiment of the present invention.
Figure 2:
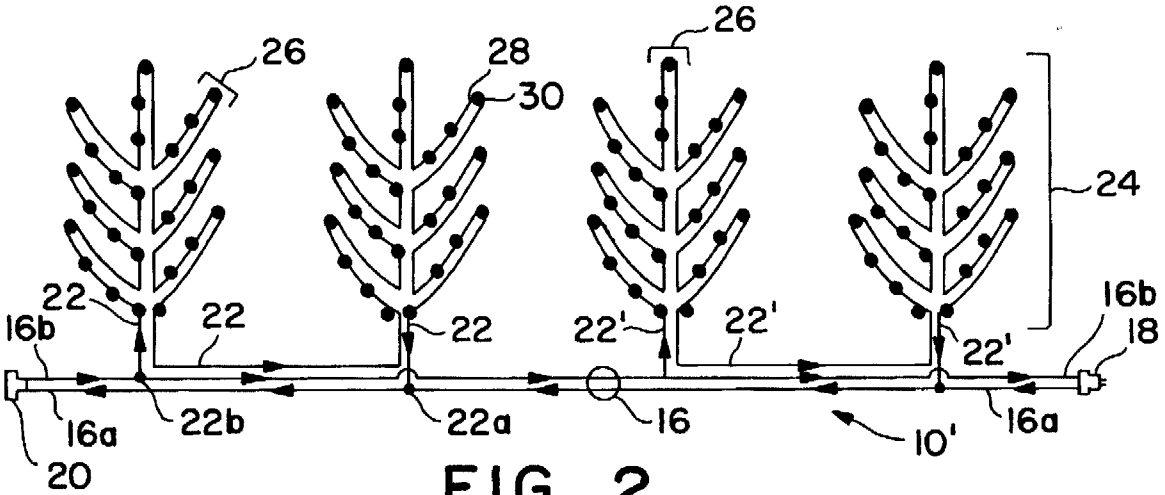
FIG. 2 is an electrical schematic of a high density embodiment of the present invention.
Figure 3:
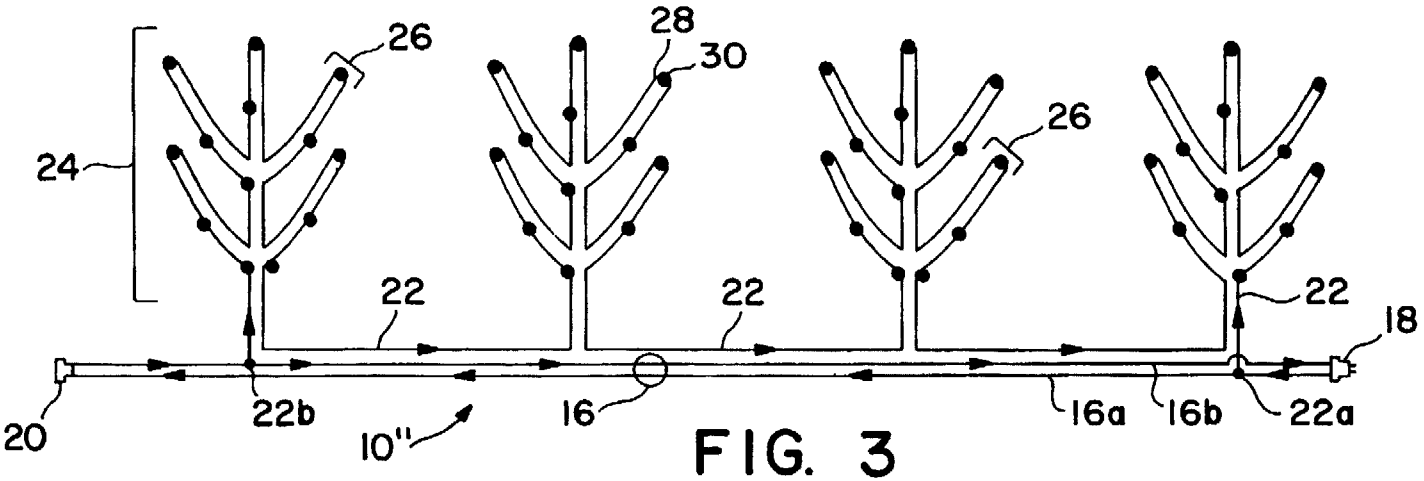
FIG. 3 is an electrical schematic of a low density embodiment of the present invention.

With reference now to FIGS. 2, 3, and 4, each decorative lighting assembly includes electrical cable 16 having primary input and output conductors 16*a* and 16*b*, respectively. Cable 16 is further provided with plug 18 and receptacle 20 at opposite ends thereof, and preferably does not exceed six feet in length so that light assembly is not prone to becoming entangled. As indicated in FIG. 1B, cable 16 is adapted for placement within tree 12 generally about trunk 14 thereof.

As indicated previously, several light string clusters 24 stem from electrical cable 16. Each cluster includes a plurality of electrically connected looped components 26 adapted for extending along branches BR or subbranches SB of the tree, and a plurality of bulb sockets 28 containing bulbs 30 electrically connected at spaced intervals in series along the respective looped components. The fact that bulb sockets 28 are connected in series permits the use of smaller wiring sizes and node sizes than if the bulb sockets were connected in parallel. Looped components 26 and bulb sockets 28 together form at least one electrical pathway 22 between nodes 22*a* and 22*b*, and thus between the primary input and output conductors of the electrical cable for creating a dense distribution of lights in the tree when the looped components are extended along the branches or subbranches of the tree and the assembly is energized by connecting plug 18 with an electrical outlet.

In the embodiments of FIGS. 2 and 3, the decorative light assembly includes at least two similar light string clusters 24 electrically connected in series to form an electrical pathway between the primary input and output conductors. FIG. 2 displays a "high density" embodiment of the invention, indicated as 10', while FIG. 3 illustrates a "low density" embodiment referenced as 10".

In FIG. 2, light assembly 10' includes four light string clusters 24 wherein the left two clusters are electrically connected to one another in series, and the right two clusters are similarly but independently electrically connected in series with one another, resulting in a two parallel electrical pathways between the primary input and output conductors of the cable. The electrical pathway formed by the left two clusters is indicated as 22, and the pathway formed by the right two clusters is indicated as 22'.

Thus, electrical pathways 22 and 22' each contain two series-connected light string clusters 24 in the high density embodiment of FIG. 2. Each electrical pathway contains fifty light bulb sockets 28 with bulbs 30, distributed as twenty-five sockets/bulbs in each of the two clusters. Looped components 26 within each of the series-connected clusters are connected to one another in series. As stated above, the two electrical pathways 22 and 22' are electrically connected to cable 16 in parallel with one another. Thus, if one of light bulbs 30 burns out, then the circuit represented by the electrical pathway that contains that bulb will be opened and the other bulbs 30 on the pathway will "go out" as well. However, light bulbs 30 in the other electrical pathway will be unaffected because its circuit will remain closed.

A low density embodiment of decorative light assembly 10" is shown in FIG. 3, wherein a single electrical pathway 22 forms four series-connected light string clusters 24. Each of looped components 26 within each light string cluster 24 of this embodiment is connected to one another in series. As a result, if one light bulb in assembly 10" of the low density embodiment burns out, all other bulbs in the assembly will go out because every bulb of the assembly is connected in series in a single circuit. Thus, the total voltage drop across the low density design of FIG. 3 is equivalent to the voltage drop across one of the electrical pathways of the high voltage design of FIG. 2. The difference being that the low density assembly 10" has greater spacing between the bulb sockets such that it carries the same number of bulbs in four clusters that the high density assembly 10' carries in two clusters.

In a still further embodiment shown in FIG. 4, looped components 26 and bulb sockets 28 of light string cluster 24 together form three electrical pathways 22, 22', and 22" in parallel with one another between the primary input and output conductors 16*a*, 16*b* of cable 16. In this "low voltage" embodiment referenced as 10'", a plurality of similar light string clusters 24 (not shown) are electrically connected in parallel to cable 16.

Thus, the voltage in cable 16 need only overcome the voltage drop across five light bulbs 30, because each of the clusters are connected in parallel and each of the electrical pathways are also connected in parallel to cable 16 within the clusters. The result of this low voltage design is that the burning out of one bulb will cause only the other four bulbs in the electrical pathway 22, 22', or 22" containing the burned out bulb to go out. Thus, it will be fairly easy to identify the burned-out bulb in the assembly. Slightly larger wiring and node sizes may be required by primary input and output conductors 16*a*, 16*b* of this embodiment because each cluster is connected in parallel to cable 16. However, the wiring and node sizes will still be smaller than if each bulb socket 28 was connected in parallel, as in the prior art '631 patent.

To install light assembly 10 in a real or artificial Christmas tree, the installer first grabs the ends of cable 16, and pulls plug 18 and receptacle 20 in opposite directions to straighten out and elongate the cable. This action ensures that light string clusters 24 quickly separate from one another, if they were entangled at all, and fall below cable 16 under the force of gravity. The cable need not be completely extended to its full length for the clusters to separate, and because the length of cable 16 does not exceed six feet this straightening action may typically be performed by one person.

The installer can then easily distribute the clusters atop the respective branches of tree 12, in one-cluster-per-branch fashion. No hooks or clips are needed to secure light assembly 10 to tree 12. Cable 16 and clusters 24 are simply positioned atop the branches of tree 12 about trunk 14 throughout one of the layers of the tree. Looped components 26 are then positioned atop the respective subbranches of the branches to create a dense distribution of lights that closely mimics the "network" of the tree's branches and subbranches.

Removal of light assembly 10 from a Christmas tree will be just as easy as installation due to the relatively short length of cable 16 and the fact that there is no need for the electrical wiring within one assembly 10, or between several assemblies 10, to intercross. In other words, there is no need for multiple strings of lights to cross each branch of tree 12, because only one cluster is needed to provide a brilliant arrangement of lights within each branch. Thus, the cluster design of the present invention provides for a dense distribution of lights that need not be duplicated by other light strings within layers of the tree.

The relatively short length of cable 16 makes the decorative light assembly of the present invention adaptable to virtually any tree size. The preferred five to six foot length of the cable is well suited for placement about the trunk of the tree to fully extend throughout a layer of branches. For larger trees, two or more assemblies 10 may be used within single layers having more branches. For smaller trees, assembly 10 may be "spiraled" between layers having fewer branches.

From the foregoing it will be seen that this invention is one well adapted to attain all of the ends and objects hereinabove set forth, together with other advantages which are obvious and which are inherent to the apparatus and structure.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

For example, the decorative light assembly can be supplemented by additional primary conductors and the power can be switched on and off among the conductors using known switching means so that certain light bulbs are made to "turn on" and "turn off," whereby a twinkling effect is produced in the tree.

What is claimed is:

1. A decorative light assembly for illuminating a tree having a trunk, branches stemming from the trunk, and subbranches stemming from the branches, comprising:

an electrical cable having primary input and output conductors with a plug at one end thereof and adapted for placement within the tree about the trunk thereof; and a plurality of light string clusters spaced along said cable, each of said clusters including central portion extending from said cable for placement generally along the longitudinal length of a branch of the tree, a plurality of looped components that extend generally laterally from and return to locations spaced along the central portion for placement generally along the subbranches of the branch, the looped components being electrically connected to the central portion, whereby the central portion and looped components are prearranged generally to mimic the shape of the branch and subbranches, and a plurality of bulb sockets electrically connected at spaced intervals in series along the respective looped components, the looped components and bulb sockets together creating a distribution of lights in the tree when the central portion and the looped components are extended along the branches and subbranches of the tree.

2. The decorative light assembly of claim 1 wherein the plurality of light string clusters are electrically connected in series to form one electrical pathway between the primary input and output conductors.

3. The decorative light assembly of claim 2 further comprising a second plurality of light string clusters electrically connected in series with one another and together forming a second electrical pathway between the primary input and output conductors of said cable in parallel with the one electrical pathway.

4. The decorative light assembly of claim 1 wherein the looped components and bulb sockets of each light string cluster together form at least two electrical pathways in parallel with one another between the primary input and output conductors of said cable.

5. The decorative light assembly of claim 4 wherein the plurality of light string clusters are electrically connected in parallel to said cable.

6. The decorative light assembly of claim 1 wherein said cable further comprises a receptacle at the other end thereof.

7. The decorative light assembly of claim 1 wherein said cable does not substantially exceed six feet in length.

8. The decorative light assembly of claim 1, wherein each of said clusters is electrically connected across the primary input and output conductors of said cable.

9. The decorative light assembly of claim 1, further comprising at least one bulb socket electrically connected along the central portion of said cluster.

* * * * *